US005534198A

United States Patent [19]

Masters et al.

[11] Patent Number: 5,534,198

[45] Date of Patent: Jul. 9, 1996

[54] GLASS CLEANER COMPOSITIONS HAVING GOOD FILMING/STREAKING CHARACTERISTICS AND SUBSTANTIVE MODIFIER TO PROVIDE LONG LASTING HYDROPHILICITY

[75] Inventors: Ronald A. Masters, Loveland; Michael S. Maile, Maineville, both of Ohio

[73] Assignee: The Procter & Gamble Company, Cincinnati, Ohio

[21] Appl. No.: 378,205

[22] Filed: Jan. 25, 1995

Related U.S. Application Data

[63] Continuation-in-part of Ser. No. 284,778, Aug. 2, 1994, abandoned.

[51] Int. Cl.[6] ..... C11D 1/12; C11D 1/88; C11D 3/43

[52] U.S. Cl. ..... 510/182; 510/181; 510/427; 510/434; 510/475; 510/476; 510/490; 510/400

[58] Field of Search ..... 252/545, 546, 252/548, 174.24, 554, 555, 558, DIG. 10, 174.21, 174.23, DIG. 2, 153, 158, 170

[56] References Cited

U.S. PATENT DOCUMENTS

| | | | |
|---|---|---|---|
| H468 | 5/1988 | Malik et al. | 252/542 |
| 2,528,378 | 10/1950 | Mannheimer | 548/352.1 |
| 3,280,179 | 10/1966 | Ernst | 260/501 |
| 3,309,321 | 3/1967 | McMaster | 252/152 |
| 3,539,521 | 11/1970 | Snoddy et al. | 252/137 |
| 3,579,455 | 5/1971 | Sabatelli et al. | 252/135 |

(List continued on next page.)

FOREIGN PATENT DOCUMENTS

| | | | |
|---|---|---|---|
| 88168 | 9/1982 | Australia | C11D 10/04 |
| 706409 | 3/1965 | Canada | 260/309.6 |
| 706408 | 3/1965 | Canada | 260/309.6 |
| 0004755A1 | 10/1979 | European Pat. Off. | C11D 1/94 |
| 0024031A1 | 2/1981 | European Pat. Off. | C11D 1/90 |
| 0040882A2 | 12/1981 | European Pat. Off. | C11D 3/16 |
| 0067635A2 | 12/1982 | European Pat. Off. | A61K 7/08 |
| 0106266A2 | 4/1984 | European Pat. Off. | C11D 3/43 |
| 0117135A2 | 8/1984 | European Pat. Off. | C11D 3/37 |
| 0205626 | 5/1985 | European Pat. Off. | C07C 143/14 |
| 0157443A1 | 10/1985 | European Pat. Off. | C11D 1/83 |
| 0181212A1 | 5/1986 | European Pat. Off. | C11D 1/94 |
| 0338850 | 10/1989 | European Pat. Off. | A61K 7/075 |
| 0373851A2 | 6/1990 | European Pat. Off. | C11D 1/94 |
| 0408174A1 | 1/1991 | European Pat. Off. | A61K 7/16 |
| 0527625A2 | 2/1993 | European Pat. Off. | C11D 3/43 |
| 2336449 | 7/1973 | Germany | C11D 1/83 |
| 275046A1 | 11/1982 | Germany | C07D 207/08 |
| 274332A3 | 11/1982 | Germany | C07C 143/15 |
| 3610395A1 | 10/1987 | Germany | A61K 7/50 |
| 4210364 | 3/1992 | Germany | C11D 3/20 |
| 4323638A1 | 1/1995 | Germany | C11D 3/37 |
| 48-60706 | 8/1973 | Japan . | |
| 59-189197 | 10/1984 | Japan | C11D 1/94 |
| 60-141797 | 7/1985 | Japan | C11D 1/94 |
| 60-161498 | 8/1985 | Japan | C11D 1/94 |
| 60-195200 | 10/1985 | Japan | C11D 1/94 |
| 61-014296 | 1/1986 | Japan | C11D 3/14 |
| 61-014298 | 1/1986 | Japan | C11D 3/43 |
| 61-009500 | 11/1986 | Japan | C11D 1/88 |
| 62-257992 | 11/1987 | Japan | C11D 3/60 |
| 63-012333 | 1/1988 | Japan | B01F 17/16 |
| 01153796 | 6/1989 | Japan | C11D 1/94 |
| 01221496 | 9/1989 | Japan | C11D 1/02 |
| 01221497 | 9/1989 | Japan | C11D 1/62 |
| 02269200 | 11/1990 | Japan | C11D 1/94 |
| 02296899 | 12/1990 | Japan | A61K 7/07 |
| 0021698 | 1/1991 | Japan . | |
| 03163052 | 7/1991 | Japan | C07C 233/47 |
| 03153797 | 7/1991 | Japan | C11D 1/88 |
| 03215410 | 9/1991 | Japan | A61K 7/07 |
| 03258900 | 11/1991 | Japan | A61K 7/07 |
| 84944 | 10/1984 | Romania | A61K 7/06 |
| 1544563 | 4/1979 | United Kingdom | C11D 1/94 |
| 2114996 | 9/1983 | United Kingdom | C11D 1/94 |
| 2193505 | 2/1988 | United Kingdom | C11D 3/33 |
| WO91/09104 | 6/1991 | WIPO | C11D 7/32 |
| WO91/09930 | 7/1991 | WIPO | C11D 1/38 |
| WO91/13610 | 9/1991 | WIPO | A61K 7/50 |
| WO91/15192 | 10/1991 | WIPO | A61K 7/50 |
| 9205235 | 4/1992 | WIPO . | |

OTHER PUBLICATIONS

Seko "Application of Polystyrene Sulfonate to Detergents" C.A. 27545r 1973 (no month available).

N. Parris et al., "Soap Based Detergent Formulations. V. Amphoteric Lime Soap Dispersing Agents," JAOCS, 50(1973) pp. 509–512.

W. R. Noble et al., "Soap–Based Detergent Formulations: X. Nature of Detergent Deposits," JAOCS, 52(1975) pp. 1–4.

N. Parris et al., "Soap–Based Detergent Formulations: XII. Alternate Syntheses of Surface Active Sulfobetaines," JAOCS, 53(1976) pp. 60–63.

F. D. Smith et al., "Soap–Based Detergent Formulations: XV. Amino Esters of alpha–Sulfo Fatty Acids," JAOCS, 53(1976) pp. 69–72.

Parris et al., "Soap–Based Detergent Formulations: XVII. Effect of Structure Variations on Surface–Active Properties of Sulfur Containing Amphoteric Surfactants", JAOCS, 53(1976) pp. 97–100.

J. K. Weil et al., "Soap–Based Detergent Formulations: XX. The Physical and Chemical Nature of Lime Soap Dispersions," JAOCS, 53(1976) pp. 757–761.

(List continued on next page.)

*Primary Examiner*—Erin M. Harriman
*Attorney, Agent, or Firm*—Robert B. Aylor

[57] ABSTRACT

Detergent compositions having good filming/streaking characteristics contain effective amounts of specific substantive materials to increase the hydrophilicity of the glass. Preferred formulas contain a amphoteric, including zwitterionic, and optionally, but preferably, anionic detergent surfactant at levels (e.g., from about 0.02 to about 15%); hydrophobic solvent; alkaline material, especially volatile alkaline materials comprising monoethanolamine or certain beta-amino-alkanol compounds; and salt of polycarboxylate, preferably polyacrylate, polymer at effective levels (e.g., from about 0.01% to about 10%, by weight of the composition).

28 Claims, No Drawings

U.S. PATENT DOCUMENTS

| | | | |
|---|---|---|---|
| 3,649,569 | 3/1972 | McCarty | 252/543 |
| 3,696,043 | 10/1972 | Labarge et al. | 252/153 |
| 3,723,322 | 3/1973 | Diehl | 252/89 |
| 3,755,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |
| 3,925,262 | 12/1975 | Laughlin et al. | 252/526 |
| 3,928,065 | 12/1975 | Savino | 134/7 |
| 3,928,251 | 12/1975 | Bolich, Jr. et al. | 252/545 |
| 3,935,130 | 1/1976 | Hirano et al. | 252/542 |
| 3,950,417 | 4/1976 | Verdicchio et al. | 252/545 |
| 3,962,418 | 6/1976 | Birkofer | 424/70 |
| 4,081,395 | 3/1978 | Talley | 252/106 |
| 4,110,263 | 8/1978 | Lindemann et al. | 252/545 |
| 4,122,043 | 10/1978 | Kersnar et al. | 252/527 |
| 4,148,762 | 4/1979 | Koch et al. | 252/544 |
| 4,181,634 | 1/1980 | Kennedy et al. | 252/545 |
| 4,186,113 | 1/1980 | Verdicchio et al. | 252/526 |
| 4,214,908 | 7/1980 | Deguchi et al. | 106/13 |
| 4,233,192 | 11/1980 | Lindemann et al. | 252/545 |
| 4,246,131 | 1/1981 | Lohr | 252/153 |
| 4,257,907 | 3/1981 | Lagguth et al. | 252/106 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,299,739 | 11/1981 | Esposito et al. | 252/545 |
| 4,329,334 | 5/1982 | Su et al. | 424/70 |
| 4,329,335 | 5/1982 | Su et al. | 424/70 |
| 4,372,869 | 2/1983 | Lindemann et al. | 252/174.16 |
| 4,396,525 | 8/1983 | Tubin et al. | 252/174 |
| 4,414,128 | 11/1983 | Goffinet | 252/111 |
| 4,420,484 | 12/1983 | Gorman et al. | 424/326 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,457,856 | 7/1984 | Mitchell et al. | 252/166 |
| 4,477,365 | 10/1984 | Verboom et al. | 252/156 |
| 4,485,029 | 11/1984 | Kato et al. | 252/106 |
| 4,529,588 | 7/1985 | Smith et al. | 424/70 |
| 4,554,098 | 11/1985 | Klisch et al. | 252/547 |
| 4,654,207 | 3/1987 | Preston | 424/70 |
| 4,673,523 | 6/1987 | Smith et al. | 252/91 |
| 4,683,008 | 7/1987 | Betts | 134/27 |
| 4,690,779 | 9/1987 | Baker et al. | 252/546 |
| 4,692,277 | 9/1987 | Siklosi | 252/558 |
| 4,698,181 | 10/1987 | Lewis | 252/527 |
| 4,769,169 | 9/1988 | Fishlock-Lomax | 252/106 |
| 4,769,172 | 9/1988 | Siklosi | 252/153 |
| 4,772,424 | 9/1988 | Greeb | 252/546 |
| 4,784,786 | 11/1988 | Smith et al. | 252/91 |
| 4,810,421 | 3/1989 | Marchesini | 252/546 |
| 4,824,605 | 4/1989 | Hildreth . | |
| 4,913,841 | 4/1990 | Zeman | 252/352 |
| 4,921,629 | 5/1990 | Malihi et al. | 252/170 |
| 4,948,531 | 8/1990 | Fuggini et al. | 252/544 |
| 5,015,412 | 5/1991 | Zeman | 252/311 |
| 5,061,393 | 10/1991 | Linares et al. | 252/170 |
| 5,108,660 | 4/1992 | Michael | 252/545 |
| 5,252,245 | 10/1993 | Garabedian, Jr. et al. | 252/153 |
| 5,290,472 | 3/1994 | Michael et al. | 252/170 |
| 5,336,445 | 3/1994 | Michael et al. | 252/548 |
| 5,342,549 | 8/1994 | Michael | 252/153 |
| 5,350,541 | 9/1994 | Michael et al. | 252/153 |
| 5,362,422 | 11/1994 | Masters | 252/544 |
| 5,376,298 | 12/1994 | Michael | 252/153 |

OTHER PUBLICATIONS

J. K. Weil et al., "The Mutual Solubilization of Soap and Lime Soap Dispersing Agents," JAOCS, 54(1977) pp. 1–3.

T. J. Micich et al., "Soap–Based Detergent Formulations: XIX. Amphoteric Alkyl–Succinamide Derivatives as Lime Soap Dispersants," JAOCS, 54(1977) pp. 91–94.

T. J. Micich et al., "Soap–Based Detergent Formulations: XXII. Sulfobetaine Derivatives of N–Alkylglutaramides and Adipamides," JAOCS, 54(1977) pp. 264–266.

N. Parris et al. "Soap–Based Detergent Formulation: XXIV. Sulfobetaine Derivatives of Fatty Amides," JAOCS, 54(1977), pp. 294–296.

J. K. Weil et al., "Surface Active Properties of Combinations of Soap and Lime Soap Dispersing Agents," JAOCS, 54(1976) pp.339–342.

J. M. Kaminski et al., "Soap–Based Detergent Formulations: XXIII. Synthesis of p–Sulfobenzyl Ammonium inner Salts and Structural Correlation with Analogous Amphoterics," JAOCS, 54(1977) pp. 516–520.

F. D. Smith et al., "Soap–Based Detergent Formulations: XXI. Amphoteric Derivatives of Fatty Amides of Aminoethylethanolamine," JAOCS, 55(1978) pp. 741–744.

J. M. Kaminski et al., "Soap–Based Detergent Formulations: XXV. Synthesis and Surface Active Properties of Higher Molecular Weight Betain Lime Soap Dispersants," JAOCS, 56(1979) pp. 771–774.

W. M. Linfield, "Soap and Lime Soap Dispersants," JAOCS, 55(1978), pp. 87–92.

W. R. Noble et al., "Soap–Based Detergent Formulations: XXVI. Hard Water Detergency of Soap–Lime Soap Dispersant Combinations with Builders and Inorganic Salts," JAOCS, 57(1980), pp. 368–372.

J. G. Weers et al., "Effect of the Intramolecular charge separation distance on the solution properties of betaines and sulfobetaines," Langmuir, 1991, vol. 7(5), pp. 854–867. (Abstract Only).

T. Takeda et al., "Synthesis and properties of a w–bis(amidopropylhydroxysulfobetain)–type amphoteric surfactants," Yukagaku, 1990, vol. 39(8), pp. 576–579. (Abstract Only).

Chem. Abstract 102(22): 190818t–P. Busch et al., "Hair–conditioning effect of quar hydroxypropyl–trimethylammonium chloride. Part I," Parfuem. Kosmet. 1984, 65(11), 692, 694–6, 698.

Chem. Abstract 192(22): 190819u–P. Busch et al., "Hair–conditioning effec of quar hydroxypropyl–trimethylammonium chloride. Part II." Parfuem. Kosmet. 1984, 65(12), 756, 758–60.

Chem. Abstract 108(1):5366g—C. A. Bunton, "Micellar effects on nucleophilicity," Adv. Chem. Ser. 1987, 215(Nucleophility), 425–41.

Chem. Abstract 115(6): 56929v—CTFA, Inc., "Final report on the safety assessment of cocamidopropyl betain," J. Am. Coll. Toxicol. 1991, 10(1). 33–52.

Chem. Abstract 115(14): 138653q—V. Allikmaa, "Highly efficient reversed–phase HPLC studies of amphoteric and cationic amido group containing surfactants," Eesti Tead. Akad. Toim., Keem 1991, 40(1), 67–72.

Soap–Based Detergent Formulations: XII. "Alternate Syntheses of Surface Active Sulfobetaines", Parris et al., J. Amer. Oil Chem. Soc., vol. 53, Feb. 1976, pp. 60–63.

Zwitterionic Surfactants: Structure and Performance, Fernly, Journal of The Oil Chemists' Society, vol. 55, Jan. 1978, pp. 98–103.

Chem. Abstract 77(12): 77046s—A. Koeber et al., REWO; "Ampholytic cycloimidinium surfactants," Soap, Cosmet., Chem. Spec., 48(5), 86, 88, 193.
Chem. Abstract 78(2): 5704c—A. Koebner et al., REWO; "Ampholytes," Ger. Offen. 10 pp. DE 2063423, published Sep. 21, 1972.
Chem. Abstract 81(11): 63632a—REWO Chemische Fabrik, "Amphoteric quaternary imidazolines useful as surface--active agents," Brit. 8 pp., GB 1,352,770, May 8, 1974.
Chem. Abstract 90(8):56735u—Hein et al., REWO, "Contribution to the structure of amphoteric surfactant," Fette--Seifen-anstrichm., 80(11), 448–53.
Chem. Abstract 103(24): 197694d—Hein, REWO; "Surface active derivatives of ricinoleic acid," Fette-Seifen-Anstrichm., 87(7), 283–8.
Chem. Abstract 105(20): 174830x—Hein, REWO; "Effect of amphoteric surfactants in light-duty detergents," Commun. Jorn. Com. Esp. Deterg., 16, 91–100.
Chem. Abstract 107(8):64650x—Zabotto et al., Orea S.A.; "Cosmetic cleansing composition, particularly eye makeup remover," Euro. Pat. Appl., 24 pp., EP 200620 A1, Dec. 10, 1986.

Chem. Abstract 113(21):188305g—Schmidt et al., Z. Naturforsch., C: Biosci., 45(6) 729–32, "Short-wavelength absorbing complexes of chlorophyll in a micellar solution of cationic detergents.".

Chem. Abstract 116(4):131640v—A. Domsch, REWO; "Amphoteric surfactants in detergents and cleaning products," Comun. Jorn. Com. Esp. Deterg., 22, 223–41.

Brochure: "Soap Scum Removal Using Varion® AM-V," Robert Pifer and James Denison, Sherex Chemical Co., Inc., Form No. 10/91, 1991.

GLASS CLEANER COMPOSITIONS HAVING GOOD FILMING/STREAKING CHARACTERISTICS AND SUBSTANTIVE MODIFIER TO PROVIDE LONG LASTING HYDROPHILICITY

This is a continuation-in-part of our U.S. patent application Ser. No. 08/284,778, filed Aug. 2, 1994, now abandoned.

FIELD OF THE INVENTION

This invention pertains to glass cleaning compositions, preferably liquid detergent compositions for use in cleaning glass, especially window glass, and, preferably, other hard surfaces. Such compositions typically contain detergent surfactants, solvents, builders, etc.

BACKGROUND OF THE INVENTION

The use of, e.g., solvents and organic water-soluble synthetic detergent surfactants at low levels for cleaning glass are known. There are several compositions known that provide good filming/streaking characteristics so that the glass is cleaned without leaving objectionable levels of spots and/or films.

Known detergent compositions comprise certain organic solvents, detergent surfactants, and optional builders and/or abrasives. The prior art, however, fails to teach, or recognize, the advantage of providing an additional material in glass cleaner formulations to provide a residual hydrophilicity.

The preferred liquid cleaning compositions have the great advantage that they can be applied to hard surfaces in neat or concentrated form so that a relatively high level of, e.g., surfactant material and/or organic solvent is delivered directly to the soil. Therefore, liquid cleaning compositions have the potential to provide superior soap scum, grease, and oily soil removal over dilute wash solutions prepared from powdered cleaning compositions. The most preferred compositions are those that provide good cleaning on tough soils and yet clean glass without leaving objectionable levels of spots and/or films.

The inclusion of detergent builders in liquid hard surface cleaning compositions increases the potential to provide superior cleaning. However, in the past, the inclusion of such detergent builders has usually produced unacceptable results for filming/streaking. The inclusion of detergent builders has therefore been considered a compromise in favor of cleaning.

Liquid cleaning compositions, and especially compositions prepared For cleaning glass, need exceptionally good filming streaking properties. In addition, they can suffer problems of product form, in particular, inhomogeneity, lack of clarity, or excessive "solvent" odor for consumer use.

SUMMARY OF THE INVENTION

The present invention relates to detergent compositions that can clean glass without leaving objectionable levels of filming and/or streaking and which contain an effective amount of substantive material which provides the glass, especially window glass, with long lasting higher hydrophilicity. Preferably, said compositions are in the form of an aqueous, liquid, hard surface detergent composition having improved cleaning and good spotting characteristics after rewetting comprising: (A) detergent surfactant selected from the group consisting of anionic surfactants, amphoteric detergent surfactants including zwitterionic surfactants; and mixtures thereof; (B) hydrophobic solvent; (C) alkaline material; (D) substantive polymer that renders glass more hydrophilic, preferably polycarboxylate polymer, in an effective amount to provide an improvement in spotting (and/or filming) after at least three rewettings of the glass, and (E) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients. The compositions can be formulated at usage concentrations, or as concentrates, either solid, or liquid, and can be packaged in a container having means for creating a spray to make application to hard surfaces more convenient.

All percentages, parts, and ratios herein are "by weight" and all amounts are approximations, unless otherwise stated.

DETAILED DESCRIPTION OF THE INVENTION

In accordance with the present invention, it has been found that superior detergent compositions for cleaning shiny surfaces such as glass which leave said surface with a desirable appearance, i.e., without objectionable levels of filming and/or streaking, can be further improved to help maintain said desirable appearance for an extended period of time by incorporating a material that is substantive to said surfaces and which provides a more hydrophilic surface. When such surfaces are rewetted, e.g., as when windows are wetted by rain, the water "sheets" off the surface and the surface is still without objectionable levels of spotting (and/or filming) after the surface dries. As anyone who has cleaned windows can attest, one of the most frustrating things that can happen after windows have been cleaned is for a rain shower to occur and leave spots on the just cleaned window. The present invention meets a long felt need. The preferred aqueous liquid detergent compositions for cleaning shiny surfaces such as glass contain (A) detergent surfactant selected from the group consisting of anionic surfactants, amphoteric detergent surfactants including zwitterionic surfactants; and mixtures thereof, preferably, $C_6$–$C_{10}$ "amphocarboxylate" detergent surfactant, zwitterionic detergent surfactant (containing both cationic and anionic groups in substantially equivalent proportions so as to be electrically neutral at the pH of use), or mixtures thereof; (B) hydrophobic, volatile, cleaning solvent; (C) alkaline buffer, preferably monoethanolamine or certain beta-amino-alkanol compounds as defined hereinafter; (D) effective level of material that is substantive to glass and which increases the hydrophilicity of glass, preferably polycarboxylate polymer, that also preferably, and surprisingly, provides a very significant detergent builder effect; and (E) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof.

(A) THE DETERGENT SURFACTANT

(1) The Amphocarboxylate Detergent Surfactant

The aqueous, liquid hard surface detergent compositions (cleaners) herein can contain from about 0.001% to about 1%, preferably from about 0.01% to about 0.5%, more preferably from about 0.02% to about 0.2%, and even more preferably from about 0.03% to about 0.08%, of $C_{6-10}$ short chain amphocarboxylate detergent surfactant. It has been found that these amphocarboxylate, and, especially glycinate, detergent surfactants provide good cleaning with superior filming/streaking for detergent compositions that are used to clean both glass and/or relatively hard-to-remove soils. Despite the short chain, the detergency is good and the short chains provide improved filming/streaking, even as compared to most of the zwitterionic detergent surfactants described hereinafter. Depending upon the level of cleaning desired and/or the amount of hydrophobic material in the composition that needs to be solubilized, one can either use only the amphocarboxylate detergent surfactant, or can combine it with cosurfactant, preferably said zwitterionic surfactants.

The "amphocarboxylate" detergent surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such detergent surfactants are available, for example: from Witco under the trade name Rewoteric AM-V®, having the formula $$C_7H_{15}C(O)NH(CH_2)_2N(CH_2CH_2OH)CH_2C(O)O(^-)Na(^+);$$

Mona Industries, under the trade name Monateric 1000®, having the formula $$C_7H_{15}C(O)NH(CH_2)_2N(CH_2CH_2OH)CH_2CH_2C(O)O(^-)Na(^+);$$

and Lonza under the trade name Amphoterge KJ-2®, having the formula $$C_{7,9}H_{15,19}C(O)NH(CH_2)_2N(CH_2CH_2OCH_2C(O)O(^-)Na(^+))CH_2C(O)O(^-)Na(^+).$$

(2) Zwitterionic Detergent Surfactant

The aqueous, liquid hard surface detergent compositions (cleaners) herein can contain from about 0.02% to about 15% of suitable zwitterionic detergent surfactant containing a cationic group, preferably a quaternary ammonium group, and an anionic group, preferably carboxylate, sulfate and/or sulfonate group, more preferably sulfonate. A more preferred range of zwitterionic detergent surfactant inclusion is from about 0.02% to about 5% of surfactant, a most preferred range is from about 0.05% to about 0.2%.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^3—[C(O)—N(R^4)—(CR^5{}_2)_nl]_mN(R^6)_2(^+)—(CR^5{}_2)_p1-y(_)$$

wherein each Y is preferably a carboxylate ($COO^-$) or sulfonate ($SO_3$—) group, more preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any $(CR^5{}_2)_p{}^1$ group; wherein ($R^6$) is like $R^4$ except preferably not hydrogen; wherein m is 0 or 1; and wherein each $n^1$ and $p^1$ are an integer from 1 to about 4, preferably from 2 to about 3, more preferably about 3. The $R^3$ groups can be branched, unsaturated, or both and such structures can provide filming/streaking benefits, even when used as part of a mixture with straight chain alkyl $R^3$ groups. The $R^4$ groups can also be connected to form ting structures such as imidazoline, pyridine, etc. Preferred hydrocarbyl amidoalkylene sulfobetaine (HASB) detergent surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning detergent compositions, especially those formulated for use on both glass and hard-to-remove soils. They are even better when used with monoethanolamine and/or specific beta-amino alkanol as disclosed herein.

A more preferred specific detergent surfactant is a $C_{10-14}$ fatty acylamidopropylene(hydroxypropylene)sulfobetaine, e.g., the detergent surfactant available from the Witco Company as a 40% active product under the trade name "REWOTERIC AM CAS Sulfobetaine®."

The level of zwitterionic detergent surfactant, e.g., HASB, in the composition is typically from about 0.02% to about 15%, preferably from about 0.05% to about 10%. The level in the composition is dependent on the eventual level of dilution to make the wash solution. For glass cleaning, the composition, when used full strength, or wash solution containing the composition, should contain from about 0.02% to about 1%, preferably from about 0.05% to about 0.5%, more preferably from about 0.05% to about 0.25%, of detergent surfactant. For removal of difficult to remove soils like grease, the level can, and should be, higher, typically from about 0.1% to about 10%, preferably from about 0.25% to about 2%. Concentrated products will typically contain from about 0.2% to about 10%, preferably from about 0.3% to about 5%. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

(3) Anionic and Optional Nonionic Detergent Surfactant

The detergent compositions, preferably aqueous, liquid hard surface detergent compositions, herein can contain, as the primary detergent surfactant, less preferred, or as the cosurfactant, preferably, from about 0.01% to about 2.0%, more preferably from about 0.01% to about 1.0% of suitable anionic detergent surfactant. The anionic surfactants are suitably water-soluble alkyl or alkylaryl compounds, the alkyl having from about 6 to about 20 carbons, and including a sulfate or sulfonate substituent group. Depending upon the level of cleaning desired one can use only the anionic detergent surfactant, or more preferably the anionic detergent surfactant can be combined with a cosurfactant, preferably an amphoteric cosurfactant. Nonionic surfactants, e.g., ethoxylated alcohols and/or alkyl phenols, can also be used as cosurfactants.

The anionic detergent surfactants herein preferably have the generic formula:

$$R^9—(R^{10})_{0-1}—SO_3(^-)M(^+)$$

wherein $R^9$ is a $C_6$–$C_{20}$ alkyl chain, preferably a $C_8$–$C_{16}$ alkyl chain; $R^{10}$, when present, is a $C_6$–$C_{20}$ alkylene chain, preferably a $C_8$–$C_{16}$ alkylene chain, a $C_6H_4$ phenylene group, or O; and M is the same as before.

The patents and references disclosed hereinbefore and incorporated by reference also disclose other detergent surfactants, e.g., anionic, and, less preferably, nonionic detergent surfactants, that can be used in small amounts, preferably as cosurfactants for the preferred amphoteric/zwitterionic detergent surfactant, the cosurfactant level being small in relation to the primary surfactant. Typical of these are the alkyl- and alkylethoxylate- (polyethoxylate) sulfates, paraffin sulfonates, olefin sulfonates, alkoxylated (especially ethoxylated) alcohols and alkyl phenols, alkyl phenol sulfonates, alpha-sulfonates of fatty acids and of fatty acid esters, and the like, which are well-known from the detergency art. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula $R—C(O)—NH—(C_2H_4)—N(C_2H_4OH)—CH_2CH(OH)CH_2SO_3M$ wherein R is an alkyl group containing from about 9 to about 18 carbon atoms and M is a compatible cation are desirable cosurfactants. These detergent surfactants are available as Miranol® CS, OS, JS, etc. The CTFA adopted name for such surfactants is cocoamphohydroxypropyl sulfonate. It is preferred that the compositions be substantially free of alkyl naphthalene sulfonates.

In general, detergent surfactants useful herein contain a hydrophobic group, typically containing an alkyl group in the $C_9$–$C_{18}$ range, and, optionally, one or more linking groups such as ether or amido, preferably amido groups. The anionic detergent surfactants can be used in the form of their sodium, potassium or alkanolammonium, e.g., triethanolammonium salts; the nonionics, not preferred, generally contain from about 5 to about 17 ethylene oxide groups. $C_{12}$–$C_{18}$ paraffin-sulfonates and alkyl sulfates are especially preferred anionic detergent surfactants in the compositions of the present type.

Some suitable surfactants for use herein in small amounts are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol® 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R^7—\overset{\overset{\displaystyle O}{\|}}{C}—N(R^8)_2$$

wherein $R^7$ is a straight-chain alkyl group containing from about 7 to about 15 carbon atoms and having an average carbon chain length of from about 9 to about 13 carbon atoms and wherein each $R^8$ is a hydroxy alkyl group containing from 1 to about 3 carbon atoms; a zwitterionic surfactant having one of the preferred formulas set forth hereinafter; or a phosphine oxide surfactant. Another suitable class of surfactants is the fluorocarbon surfactants, examples of which are FC-129®, a potassium fluorinated alkylcarboxylate and FC-170-C®, a mixture of fluorinated alkyl polyoxyethylene ethanols, both available from 3M Corporation, as well as the Zonyl® fluorosurfactants, available from DuPont Corporation. It is understood that mixtures of various surfactants can be used.

(4) Mixtures

Mixtures of amphocarboxylate, zwitterionic detergent surfactants, and/or anionic detergent surfactants as discussed hereinbefore, can be present in the present invention. The zwitterionic detergent surfactants can be present at levels from about 0.02% to about 15%. The amphocarboxylate detergent surfactants can be present at levels from about 0.001% to about 15%. The ratio of zwitterionic detergent surfactant to amphocarboxylate detergent surfactant is typically from about 3:1 to about 1:3, preferably from about 2:1 to about 1:2, more preferably about 1:1. The ratio of primary detergent surfactant to cosurfactant, or cosurfactants, is typically from about 3:1 to about 1:1.

B. HYDROPHOBIC SOLVENT

In order to improve cleaning in liquid compositions, one can use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T \left[ \frac{a - l}{a} \right]^{1/2}$$

wherein γH is the hydrogen bonding parameter, a is the aggregation number, $$(\text{Log } \alpha = 3.39066 T_b/T_c - 0.15848 - \text{Log } \underline{M})_d, \text{ and}$$

γT is the solubility parameter which is obtained from the formula:

$$\gamma T = \left[ \frac{(\Delta H_{25} - RT)d}{M} \right]^{1/2}$$

where $\Delta H_{25}$ is the heat of vaporization at 25° C., R is the gas constant (1.987 cal/mole/deg), T is the absolute temperature in °K., $T_b$ is the boiling point in °K., $T_c$ is the critical temperature in °K., d is the density in g/ml, and M is the molecular weight.

For the compositions herein, hydrogen bonding parameters are preferably less than about 7.7, more preferably from about 2 to about 7, or 7.7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Hydrophobic solvents are typically used at a level of from about 0.5% to about 30%, preferably from about 2% to about 15%, more preferably from about 3% to about 8%. Dilute compositions typically have solvents at a level of from about 1% to about 10%, preferably from about 3% to about 6%. Concentrated compositions contain from about 10% to about 30%, preferably from about 10% to about 20% of solvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Genetically, glycol ethers useful herein have the formula $R^{11}$ O—($R^{12}$O—)$_m$1H wherein each $R^{11}$ is an alkyl group which contains from about 3 to about 8 carbon atoms, each $R^{12}$ is either ethylene or propylene, and $m^1$ is a number from 1 to about 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Solvents such as pine oil, orange terpene, benzyl alcohol, n-hexanol, phthalic acid esters of $C_{1-4}$ alcohols, butoxy propanol, Butyl Carbitol® and 1 (2-n-butoxy-1-methylethoxy)propane- 2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxypropanol solvent should have no more than about 20%, preferably no more than about 10%, more preferably no more than about 7%, of the secondary isomer in which the butoxy group is attached to the secondary atom of the propanol for improved odor.

C. ALKALINITY SOURCE

The aqueous liquid hard surface compositions can contain herein from about 0.05% to about 10%, by weight of the composition, of alkaline material, preferably comprising or consisting essentially of, monoethanolamine and/or beta-aminoalkanol compounds.

Monoethanolamine and/or beta-aminoalkanol compounds serve primarily as solvents when the pH is above about 10, and especially above about 10.7. They also provide alkaline buffering capacity during use. However, the most unique contribution they make is to improve the filming/streaking properties of hard surface cleaning compositions containing zwitterionic detergent surfactant, amphocarboxylate detergent surfactant, or mixtures thereof, whereas they do not provide any substantial improvement in filming/streaking when used with conventional anionic or ethoxylated nonionic detergent surfactants. The reason for the improvement is not known. It is not simply a pH effect, since the improvement is not seen with conventional alkalinity sources. Other similar materials that are solvents do not provide the same benefit and the effect can be different depending upon the other materials present. When perfumes that have a high percentage of terpenes are incorporated, the benefit is greater for the beta-alkanolamines, and they are often preferred, whereas the monoethanolamine is usually preferred.

Monoethanolamine and/or beta-alkanolamine are used at a level of from about 0.05% to about 10%, preferably from about 0.2% to about 5%. For dilute compositions they are typically present at a level of from about 0.05% to about 2%, preferably from about 0.1% to about 1.0%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

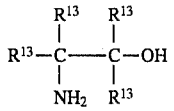

wherein each $R^{13}$ is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino, 1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

The beta-aminoalkanols are surprisingly better than, e.g., monoethanolamine for hard surface detergent compositions that contain perfume ingredients like terpenes and similar materials. However, normally the monoethanolamine is preferred for its effect in improving the filming/streaking performance of compositions containing zwitterionic detergent surfactant. The improvement in filming/streaking of hard surfaces that is achieved by combining the monoethanolamine and/or beta-aminoalkanol was totally unexpected.

Good filming/streaking, i.e., minimal, or no, filming/streaking, is especially important for cleaning of, e.g., window glass or mirrors where vision is affected and for dishes and ceramic surfaces where spots are aesthetically undesirable. Beta-aminoalkanols provide superior cleaning of hard-to-remove greasy soils and superior product stability, especially under high temperature conditions, when used in hard surface cleaning compositions, especially those containing the zwitterionic detergent surfactants. Beta-aminoalkanols, and especially the preferred 2-amino-2-methylpropanol, are surprisingly volatile from cleaned surfaces considering their relatively high molecular weights.

The compositions can contain, either alone or in addition to the preferred alkanolamines, more conventional alkaline buffers such as ammonia; other $C_{2-4}$ alkanolamines; alkali metal hydroxides; silicates; borates; carbonates; and/or bicarbonates. Thus, the buffers that are present usually comprise the preferred monoethanolamine and/or beta-aminoalkanol and additional conventional alkaline material. The total amount of alkalinity source is typically from 0% to about 5%, preferably from 0% to about 0.5%, to give a pH in the product, at least initially, in use of from about 9 to about 12, preferably from about 9.5 to about 11.5, more preferably from about 9.5 to about 11.3. pH is usually measured on the product.

(D) SUBSTANTIVE MATERIAL THAT INCREASES HYDROPHILICITY OF GLASS

An essential part of this invention is the substantive material that improves the hydrophilicity of the surface being treated, especially glass. This increase in hydrophilicity provides improved appearance when the surface is rewetted and then dried. The water "sheets" off the surface and thereby minimizes the formation of, e.g., "rainspots" that form upon drying. Many materials can provide this benefit, but the preferred materials are polymers that contain hydrophilic groups, especially sulfonate and/or carboxylate groups. Other materials that can provide substantivity and hydrophilicity include cationic materials that also contain hydrophilic groups and polymers that contain multiple ether linkages. Cationic materials include cationic sugar and/or starch derivatives and the typical block copolymer detergent surfactants based on mixtures of polypropylene oxide and ethylene oxide are representative of the polyether materials. The polyether materials are less substantive, however.

The preferred polycarboxylate polymers are those formed by polymerization of monomers, at least some of which contain carboxylic functionality. Common monomers include acrylic acid, maleic acid, ethylene, vinyl pyrrollidone, methacrylic acid, methacryloylethylbetaine, etc. Preferred polymers for substantivity are those having higher molecular weights. For example, polyacrylic acid having molecular weights below about 10,000 are not particularly substantive and therefore do not normally provide hydrophilicity for three rewettings with all compositions, although with higher levels and/or certain surfactants like amphoteric and/or zwitterionic detergent surfactants, molecular weights down to about 1000 can provide some results. In general, the polymers should have molecular weights of more than 10,000, preferably more than about 20,000, more preferably more than about 300,000, and even more preferably more than about 400,000. It has also been found that higher molecular weight polymers, e.g., those having molecular weights of more than about 3,000,000, are extremely difficult to formulate and are less effective in providing anti-spotting benefits than lower molecular weight polymers. Accordingly, the molecular weight should normally be, especially for polyacrylates, from about 20,000 to about 3,000,000; preferably from about 20,000 to about 2,500,000; more preferably from about 300,000 to about 2,000,000; and even more preferably from about 400,000 to about 1,500,000.

An advantage for some polycarboxylate polymers is the detergent builder effectiveness of such polymers. Surprisingly, such polymers do not hurt filming/streaking and like other detergent builders, they provide increased cleaning effectiveness on typical, common "hard-to-remove" soils that contain particulate matter.

Some polymers, especially polycarboxylate polymers, thicken the compositions that are aqueous liquids. This can be desirable. However, when the compositions are placed in containers with trigger spray devices, the compositions are desirably not so thick as to require excessive trigger pressure. Typically, the viscosity under shear should be less than about 200 cp, preferably less than about 100 cp, more preferably less than about 50 cp. It can be desirable, however, to have thick compositions to inhibit the flow of the composition off the surface, especially vertical surfaces.

Other suitable materials include high molecular weight sulfonated polymers such as sulfonated polystyrene. A typical formula is as follows.

$$-[CH(C_6H_4SO_3Na)-CH_2]_n-CH(C_6H_5)-CH_2-$$

wherein n is a number to give the appropriate molecular weight as disclosed below.

Typical molecular weights are from about 10,000 to about 1,000,000, preferably from about 200,000 to about 700,00.

Examples of suitable materials for use herein include poly(vinyl pyrrolidone/acrylic acid) sold under the name "Acrylidone"® by ISP and poly(acrylic acid) sold under the name "Accumer"® by Rohm & Haas. Other suitable materials include sulfonated polystyrene polymers sold under the name Versaflex® sold by National Starch and Chemical Company, especially Versaflex 7000.

The level of substantive material should normally be from about 0.01% to about 10%, preferably from about 0.05% to about 0.5%, more preferably from about 0.1% to about 0.3%. In general, lower molecular weight materials such as lower molecular weight poly(acrylic acid), e.g., those having molecular weights below about 10,000, and especially about 2,000, do not provide good anti-spotting benefits upon rewetting, especially at the lower levels, e.g., about 0.02%. One should use only the more effective materials at the lower levels. In order to use lower molecular weight materials, substantivity should be increased, e.g., by adding groups that provide improved attachment to the surface, such as cationic groups, or the materials should be used at higher levels, e.g., more than about 0.05%.

(E) AQUEOUS SOLVENT SYSTEM

The balance of the formula is typically water and non-aqueous polar solvents with only minimal cleaning action like methanol, ethanol, isopropanol, ethylene glycol, glycol ethers having a hydrogen bonding parameter of greater than 7.7, propylene glycol, and mixtures thereof, preferably isopropanol. The level of non-aqueous polar solvent is usually greater when more concentrated formulas are prepared. Typically, the level of non-aqueous polar solvent is from about 0.5% to about 40%, preferably from about 1% to about 10%, more preferably from about 2% to about 8% (especially for "dilute" compositions) and the level of water is from about 50% to about 99%, preferably from about 75% to about 95%.

(F) OPTIONAL INGREDIENTS

The compositions herein can also contain other various adjuncts which are known to the art for detergent compositions. Preferably they are not used at levels that cause unacceptable filming/streaking Non-limiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on filming/streaking in the cleaning of glass. Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. The perfumes are preferably those that are more water-soluble and/or volatile to minimize streaking and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Stabilizing ingredients can be present typically to stabilize more of the hydrophobic ingredients, e.g., perfume. The stabilizing ingredients include acetic acid and propionic acids, and their salts, e.g., $NH_4$, MEA, Na, K, etc., preferably acetic acid and the $C_2$–$C_6$ alkane diols, more preferably butane diol. The stabilizing ingredients do not function in accordance with any known principle. Nonetheless, the combination of amido zwitterionic detergent surfactant with linear acyl amphocarboxylate detergent surfactant, anionic detergent surfactant, nonionic detergent surfactant, or mixtures thereof, and stabilizing ingredient can create a microemulsion. The amount of stabilizing ingredient is typically from about 0.01% to about 0.5%, preferably from about 0.02% to about 0.2%. The ratio of hydrophobic material, e.g., perfume that can be stabilized in the product is related to the total surfactant and typically is in an amount that provides a ratio of surfactant to hydrophobic material of from about 1:2 to about 2:1.

Other detergent builders that are efficient for hard surface cleaners and have reduced filming/streaking characteristics at the critical levels can also be present in the compositions of the invention. Addition of specific detergent builders at critical levels to the present composition further improves cleaning without the problem of filming/streaking that usually occurs when detergent builders are added to hard surface cleaners. There is no need to make a compromise between improved cleaning and acceptable filming/streaking results, which is especially important for hard surface cleaners which are also directed at cleaning glass. These compositions containing these specific additional detergent builders have exceptionally good cleaning properties. They also have exceptionally good "shine properties, i.e., when used to clean glossy surfaces, without rinsing, they have much less tendency than, e.g., carbonate built products to leave a dull finish on the surface and filming/streaking.

Suitable additional optional detergent builders include salts of ethylenediaminetetraacetic acid (hereinafter EDTA), citric acid, nitrilotriacetic acid (hereinafter NTA), sodium carboxymethylsuccinic acid, sodium N-(2-hydroxypropyl)-iminodiacetic acid, and N-diethyleneglycol-N,N-diacetic acid (hereinafter DIDA). The salts are preferably compatible and include ammonium, sodium, potassium and/or alkanolammonium salts. The alkanolammonium salt is preferred as described hereinafter. A preferred detergent builder is NTA (e.g., sodium), a more preferred builder is citrate (e.g., sodium or monoethanolamine), and a most preferred builder is EDTA (e.g., sodium).

These additional optional detergent builders, when present, are typically at levels of from about 0.05% to about 0.5%. more preferably from about 0.05% to about 0.3%, most preferably from about 0.05% to about 0.15%. The levels of these additional builders present in the wash solution used for glass should be less than about 0.2%. Therefore, typically, dilution is highly preferred for cleaning glass, while full strength is preferred for general purpose cleaning, depending on the concentration of the product.

Typically the best filming/streaking results occurs most when the builder is combined with amphoteric and/or zwitterionic detergent surfactant compositions although an improvement is also seen with the less preferred anionic or anionic/nonionic detergent surfactant compositions.

The invention is illustrated by the following nonlimiting Examples.

Filming/Streaking Stress Test

Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading by expert judges. After initial grading, the residues are then buffed with a dry paper towel with a uniform, consistent motion. The buffed residues are then graded by expert judges.

Grading:

Expert judges are employed to evaluate the specific areas of product application for amount of filming/streaking. A numerical value describing the amount of filming/streaking is assigned to each product. For the test results reported here a 0–6 scale is used.

0=No Filming/Streaking

6=Poor Filming/Streaking

Room temperature and humidity have been shown to influence filming/streaking Therefore, these variables are always recorded.

EXAMPLE I

| Ingredient | Formula No. (Wt. %) 1 | 2 | 3 | 4 | 5 |
|---|---|---|---|---|---|
| IPA[1] | 2.0 | 2.0 | 2.0 | 2.0 | 2.0 |
| BP[2] | 2.0 | 2.0 | 2.0 | 2.0 | 2.0 |
| MEA[3] | 0.25 | 0.25 | 0.25 | 0.25 | 0.25 |
| Cocoamidopropyl-hydroxy-sultaine | 0.1 | 0.1 | 0.1 | 0.1 | 0.1 |
| Capryloamido(carboxy-methoxyethyl)glycinate | 0.05 | 0.05 | 0.05 | 0.05 | 0.05 |
| Polymer Additive | 0.0 | 0.2[4] | 0.2[5] | 0.2[6] | 0.2[7] |
| Soft Water to Balance | ◄═══BALANCE═══► | | | | |

Filming/Streaking Stress Test on Glass Windows
(Four Replications at 22° C. and 62% Relative Humidity)

| Formula No. | Rating |
|---|---|
| 1 | 1.0 |
| 2 | 0.5 |
| 3 | 0.8 |
| 4 | 1.2 |
| 5 | 2.8 |

[1]Isopropanol
[2]Butoxypropanol
[3]Monoethanolamine
[4]Vinyl pyrrolidone/acrylic acid copolymer (MW about 250,000)
[5]Sodium Polyacrylate (MW about 2,000)
[6]Sodium Polyacrylate (MW about 450,000)
[7]Sodium Polyacrylate (MW about 3,000,000)

The least significant difference between mean ratings is 1.1 at the 95% confidence level.

The above shows that the addition of the indicated polymers at the desired levels does not cause unacceptable filming/streaking results until the polymer molecular weight is about 3,000,000, and in some cases the polymer actually improves filming/streaking results.

The following test is used to evaluate the compositions' cleaning performance.

Preparation of Soiled Panels

Enamel splash panels are selected and cleaned with a mild, light duty liquid cleanser, then cleaned with isopropanol, and rinsed with distilled or deionized water. Greasy-particulate soil is weighed (2.0 grams) and placed on a sheet of aluminum foil. The greasy-particulate soil is a mixture of about 77.8% commercial vegetable oils and about 22.2% particulate soil composed of humus, fine cement, clay, ferrous oxide, and carbon black. The soil is spread out with a spatula and rolled to uniformity with a small roller. The uniform soil is then rolled onto the clean enamel plates until an even coating is achieved. The panels are then equilibrated in air and then placed in a preheated oven and baked at 140° C. for 45–60 minutes. Panels are allowed to cool to room temperature and can either be used immediately, or aged for one or more days. The aging produces a tougher soil that typically requires more cleaning effort to remove.

Soil Removal

A Gardner Straight Line Washability Machine is used to perform the soil removal. The machine is fitted with a carriage which holds the weighted cleaning implement. The cleaning implements used for this test were clean cut sponges. Excess water is wrung out from the sponge and 5.0 grams of product are uniformly applied to one surface of the sponge. The sponge is fitted into the carriage on the Gardner machine and the cleaning test is run.

The average number of Gardner machine strokes necessary to achieve 95–99% removal of soil are obtained.

| Formula No. | Average Number of Strokes |
|---|---|
| 1 | 68 |
| 2 | 14.7 |
| 3 | 13.7 |
| 4 | 14 |
| 5 | 13.7 |

*Two replicates, greasy-particulate soil.

The above shows the cleaning improvement when a polycarboxylate polymer is added to the composition.

The least significant difference is 7.6 strokes at the 95% confidence level.

The following test is used to determine the lasting effects of preventing filming/streaking upon rewetting.

The windows, or mirrors, from the Filming/Streaking Test are rewetted by spraying with water containing about 0.02% household dust to simulate rain and dried, and this cycle is repeated twice more for a total of three cycles. The windows, or mirrors, are graded while wet using a scale in which 0=No Sheeting and 6=Heavy Sheeting. The sheeting is indicative of the hydrophilicity and the resulting lack of spotting/filming when dry.

| Formula No. | Average Sheeting Grade |
|---|---|
| 1 | 1.5 |
| 2 | 5 |
| 3 | 4.5 |
| 4 | 5.5 |
| 5 | 3.5 |

The above demonstrates the benefit of the polymers, when used at this level, in providing the sheeting (anti-spotting/filming) benefit upon rewetting.

EXAMPLE II

| Ingredient | Formula No. (Wt. %) 1 | 2 | 3 |
|---|---|---|---|
| IPA | 4.0 | 4.0 | 4.0 |
| Ethylene Glycol Monobutyl Ether | 2.5 | 2.5 | 2.5 |
| Sodium Lauryl Sulfate | 0.1 | 0.1 | 0.1 |
| FC-129 Fluorosurfactant | 0.06 | 0.06 | 0.06 |
| Sodium Polyacrylate | — | 0.2[8] | 0.2[9] |
| Ammonia | 0.16 | 0.16 | 0.16 |
| Deionized (DI) Water to Balance | ⟵BALANCE⟶ | | |

[8]Sodium Polyacrylate (MW 2,000)
[9]Sodium Polyacrylate (MW 450,000)

The above formulas are tested as in the above test for sheeting, but the samples are dried and graded for "rainspots" using the grading scale of the Filming/Streaking Test.

| Formula No. | Average "Rainspot" Grade |
|---|---|
| 1 | 1.5 |
| 2 | 2.2 |
| 3 | 0.3 |

The above shows that the polymers work with other kinds of formulas that have good filming/streaking performance, but that the lower molecular weight polymers do not always deposit sufficiently to provide the rainspot benefit. It is believed that compositions containing amphoteric and/or zwitterionic detergent surfactants provide superior performance in this regard even when the molecular weight is below about 10,000.

EXAMPLE III

| Ingredient | Formula No. (Wt. %) 1 | 2 | 3 |
|---|---|---|---|
| IPA | 3.0 | 3.0 | 3.0 |
| Ethylene Glycol Monohexyl Ether | 0.75 | 0.75 | 0.75 |
| Sodium Dodecylbenzenesulfonate | 0.25 | 0.25 | 0.25 |
| Perfume | 0.02 | 0.02 | 0.2 |
| Sodium Polyacrylate (MW 450,000) | — | 0.2 | 0.02 |
| Ammonia | 0.15 | 0.15 | 0.15 |
| Deionized (DI) Water to Balance | ⟵BALANCE⟶ | | |

The above formulas are tested as in the above test for sheeting, but for only two cycles and the glass samples were previously treated with the same composition with a lower level (about 0.02%) of polyacrylate (Formula 3) which did not give a significant benefit. Also, the samples are "dry buffed" after the surface is dried in the initial treatment, since without dry buffing the glass does not have good filming/streaking grades. The samples are dried and graded as in the Filming/Streaking Test. The results show that higher levels of higher molecular weight polymers are needed for good spotting and/or filming upon rewetting.

| Formula No. | Average "Rainspot" Grade |
|---|---|
| 1 | 2.2 |
| 2 | 0.0 |
| 3 | 1.8 |

EXAMPLE IV

| Ingredient | Formula No. (Wt. %) 1 | 2 | 3 |
|---|---|---|---|
| Ethanol | 2.8 | 2.8 | 2.8 |
| Ethylene Glycol Monobutyl Ether | 2.8 | 2.8 | 2.8 |
| Sodium Alkyl ($C_8$, $C_{12}$, and $C_{14}$) Sulfate | 0.2 | 0.2 | 0.2 |
| Versaflex 7000 | — | — | 0.1 |
| Versaflex 2004 | — | 0.1 | — |
| Polymer[4] | 0.1 | — | — |
| Perfume, NaOH(pH 9.5), and Soft Water to Balance | ⟵BALANCE⟶ | | |

Versaflex 2004 and 7000 are sodium sulfonated polystyrenes from National Starch and Chemical Company.
[4]Vinyl pyrrolidone/acrylic acid copolymer (MW about 250,000)

The above formulas are tested for 3 cycles as in the above test for sheeting, but the samples are dried and graded for "rainspots" using the grading scale of the Filming/Streaking Test.

| Formula No. | Average "Rainspot" Grade |
|---|---|
| 1 | 1.0 |
| 2 | 2.6 |
| 3 | 1.1 |

The above shows that the sulfonated styrene polymers work as well as the polyacrylates that have good filming/streaking performance, but that the lower molecular weight polymers do not always deposit sufficiently to provide the rainspot benefit.

What is claimed is:

1. An aqueous liquid hard surface detergent composition having improved cleaning and good filming/streaking characteristics after rewetting and comprising:

(A) from about 0.001% to about 2% by weight of detergent surfactant selected from the group consisting of:

(1) an amphocarboxylate detergent surfactant having the general formula:

$$RN(R^1)(CH_2)_nN(R^2)(CH_2)_pC(O)OM$$

wherein R is a $C_{6-10}$ hydrophobic fatty acyl moiety which in combination with the nitrogen atom forms an amido group, $R^1$ is hydrogen or a $C_{1-2}$ alkyl group, each $R^2$ is a $C_{1-3}$ alkyl or substituted $C_{1-3}$ alkyl, each n is an integer from 1 to 3, each p is an integer from 1 to 2, and M is a water-soluble cation selected from alkali metal, ammonium, alkanolammonium, and mixtures thereof;

(2) a zwitterionic detergent surfactant having the general formula:

$$R^3—[C(O)—N(R^4)—(CR^5{}_2)_{n1}—]_mN(R^6)_2{}^{(+)}—(CR^5{}_2)_{p1}—Y^{(-)}$$

each $R^3$ is an alkyl, or alkylene, group containing from about 10 to 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any $(CR^5{}_2)_{p1}$ moiety; m is 0 or 1; each n1 and p1 is a number from 1 to about 4; and wherein Y is selected from the group consisting of a carboxylate or sulfonate group;

(3) an anionic detergent surfactant having the generic formula:

$$R^9—(R^{10})_{0-1}—SO_3^{(-)}M^{(+)}$$

wherein each $R^9$ is a $C_6$–$C_{20}$ alkyl chain; $R^{10}$ is a $C_6$—$C_{20}$ alkylene chain, a $C_6H_4$ phenlyene group or O; and M is a water-soluble cation selected from alkali metal, ammonium, alkanolammonium, and mixtures thereof; and (4) mixtures thereof;

(B) from about 0.5% to about 15% by weight of hydrophobic solvent having a hydrogen bonding parameter of from about 2 to about 7.7;

(C) alkaline material to provide a pH, measured on the product, of from about 9 to about 12;

(D) from about 0.01% to about 0.3% by weight of substantive polymer that makes glass more hydrophilic, in an effective amount to provide an improvement in spotting/filming after at least three rewettings of the glass, said polymer being selected from the group consisting of polycarboxylate polymers having a molecular weight of from about 10,000 to about 3,000,000, and sulfonated polystyrene polymers having a molecular weight of from about 10,000 to about 1,000,000; and (E) the balance being an aqueous solvent system comprising water and optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof.

2. An aqueous liquid hard surface detergent composition according to claim 1 wherein said substantive polymer is selected from the group consisting of said polycarboxylate polymers and wherein said alkaline material is present at from about 0.05% to about 10% by weight.

3. The composition of claim 2 wherein the primary surfactant is (A)(1), (A)(2), or mixtures thereof containing at least one cosurfactant selected from the group consisting of anionic detergent surfactants selected from the group consisting of $C_{12}$–$C_{18}$ paraffin sulfonates, $C_{12}$–$C_{18}$ acylamidoalkylene sulfonates at a pH of more than about 9.5, and mixtures thereof, and nonionic detergent surfactants and mixtures thereof.

4. The composition of claim 3 wherein said cosurfactant is a nonionic detergent selected from the group consisting of alkoxylated alcohols and alkyl phenol ethoxylates.

5. The composition of claim 2 comprising (A)(4) wherein (A)(2) is present at a level of from about 0.02% to about 0.2%.

6. The composition of claim 5 wherein the mixture (A)(4) comprises (A)(1) and (A)(2) in a ratio of from about 3:1 to about 1:3.

7. The composition of claim 5 wherein the mixture (A)(4) comprises (A)(1) and (A)(2) in a ratio of from about 2:1 to about 1:2.

8. The composition of claim 2 wherein said alkaline material is an alkanolamine selected from the group consisting of monoethanolamine, beta-amino-alkanol, containing from about three to about six carbons, and mixtures thereof.

9. The composition of claim 8 wherein said alkaline material is monoethanolamine.

10. The composition of claim 8 wherein said alkaline material additionally comprises alkali metal hydroxide and has a pH of from about 9.5 to about 11.3.

11. The composition of claim 2 wherein said solvent (B) is selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonobutyl ether, and mixtures thereof.

12. The composition of claim 11 wherein said solvent (B) is monopropyleneglycolmonobutyl ether.

13. The composition of claim 12 wherein the level of said solvent (B) is from about 2% to about 15%.

14. The composition of claim 2 wherein said polycarboxylate polymer has a molecular weight from about 10,000 to about 2,500,00.

15. The composition of claim 14 wherein said polycarboxylate polymer has a molecular weight from about 20,000 to about 2,500,000.

16. The composition of claim 14 wherein said polycarboxylate polymer is present at a level of from about 0.1% to about 0.3% and has a molecular weight from about 300,000 to about 2,000,000.

17. The composition of claim 16 wherein said polycarboxylate polymer has a molecular weight from about 400,000 to about 1,500,000.

18. The composition of claim 2 comprising A(1) wherein n is 2 and p is 1.

19. The aqueous, liquid hard surface detergent composition of claim 2 wherein the surfactant is (A)(2).

20. The composition of claim 19 wherein Y is a sulfonate group, said $R^3$ group contains from about 9 to about 15 carbon atoms, each $R^6$ is methyl, one of the $R^5$ groups between the (+) and the (–) charge centers is a hydroxy group and the remaining $R^5$ groups are hydrogen, and p is 3.

21. The composition of claim 20 containing at least one cosurfactant selected from the group consisting of anionic detergent surfactants, nonionic detergent surfactant, and mixtures thereof, the ratio of surfactant to cosurfactant being from about 3:1 to about 1:1.

22. The composition of claim 21 wherein said cosurfactant is an anionic detergent selected from the group consisting of $C_{12}$–$C_{18}$ alkyl sulfates, $C_{12}$–$C_{18}$ paraffin sulfonates, $C_{12}$–$C_{18}$ acylamidoalkylene sulfonates at a pH of more than about 9.5, and mixtures thereof.

23. The composition of claim 20 wherein said alkaline material is an alkanolamine selected from the group consisting of monoethanolamine, beta-amino-alkanol, containing from about three to about six carbons, and mixtures thereof.

24. The composition of claim 19 wherein said solvent (B) is selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonobutyl ether, and mixtures thereof.

25. The composition of claim 24 wherein said solvent (B) is monopropyleneglycolmonobutyl ether.

26. The composition of claim 1 wherein said substantive material is sulfonated polystyrene polymer.

27. The composition of claim 1 containing less than about 0.1% by weight of said substantive polymer, said polymer being a polycarboxylate polymer,

28. The composition of claim 1 containing less than about 0.1% by weight of said substantive polymer, said polymer being a sulfonated polystyrene polymer.

* * * * *